US010350890B2

(12) United States Patent
Kobayashi

(10) Patent No.: US 10,350,890 B2
(45) Date of Patent: Jul. 16, 2019

(54) LIQUID DISCHARGE HEAD, AND RECORDING DEVICE USING THE SAME

(71) Applicant: KYOCERA Corporation, Kyoto-shi, Kyoto (JP)

(72) Inventor: Naoki Kobayashi, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 15/513,678

(22) PCT Filed: Sep. 17, 2015

(86) PCT No.: PCT/JP2015/076500
§ 371 (c)(1),
(2) Date: Mar. 23, 2017

(87) PCT Pub. No.: WO2016/047553
PCT Pub. Date: Mar. 31, 2016

(65) Prior Publication Data

US 2017/0297331 A1 Oct. 19, 2017

(30) Foreign Application Priority Data

Sep. 26, 2014 (JP) ..... 2014-196859

(51) Int. Cl.
*B41J 2/14* (2006.01)
*B41J 2/18* (2006.01)

(52) U.S. Cl.
CPC ..... *B41J 2/14233* (2013.01); *B41J 2/14* (2013.01); *B41J 2/14274* (2013.01); *B41J 2/18* (2013.01); *B41J 2202/12* (2013.01)

(58) Field of Classification Search
CPC ..... B41J 2/14233
See application file for complete search history.

(56) References Cited

U.S. PATENT DOCUMENTS

2006/0132551 A1* 6/2006 Chikamoto ..... B41J 2/14209 347/71
2007/0103519 A1* 5/2007 Takahashi ..... B41J 2/14209 347/85

(Continued)

FOREIGN PATENT DOCUMENTS

CN 106794696 A 5/2017
EP 1403053 A1 3/2004

(Continued)

OTHER PUBLICATIONS

Machine generated, English translation of JPS59-145158 to Shimura et al., "Ink Jet Recoridng Head"; translation obtained via https://worldwide.espacenet.com/advancedSearch?DB=EPODOC&submitted=false&locale=en_EP&AB=&ST=advanced&compact=false; translation obtained on Oct. 30, 2018; 3pp.*

(Continued)

*Primary Examiner* — Shelby L Fidler
(74) *Attorney, Agent, or Firm* — Volpe and Koenig, P.C.

(57) ABSTRACT

A liquid discharge head to improve reliability of a dummy pressurization chamber, and a recording device including the liquid discharge head, the liquid discharge head including a channel member having discharge holes, pressurization chambers, a dummy pressurization chamber, and a substrate having pressurizing parts. The channel member includes a pressurization chamber plate, a dummy pressurization chamber plate, and stacked plates. A hole of the pressurization chamber plate has a side surface configuring a side surface of the pressurization chamber, and the hole has an opening configuring an opening of the pressurization chamber. A hole of the dummy pressurization chamber plate has a side surface configuring a side surface of the dummy pressurization chamber, and the hole has an opening configuring an opening of the dummy pressurization chamber. The substrate closes the openings of the pressurization (Continued)

chambers. The pressurization chamber plate closes the opening of the dummy pressurization chamber.

8 Claims, 7 Drawing Sheets

(56) References Cited

U.S. PATENT DOCUMENTS

| | | | | |
|---|---|---|---|---|
| 2011/0085012 | A1 | 4/2011 | Nishikawa et al. | |
| 2011/0292130 | A1* | 12/2011 | Hayashi | B41J 2/14032 347/54 |

FOREIGN PATENT DOCUMENTS

| | | | | | |
|---|---|---|---|---|---|
| EP | 3196026 | A1 | | 7/2017 | |
| JP | 59145158 | A | * | 8/1984 | B41J 2/14233 |
| JP | 2004-358872 | A | | 12/2004 | |
| JP | 2009-143168 | A | | 7/2009 | |
| JP | 2014-024270 | A | | 2/2014 | |
| JP | 2014-144561 | A | | 8/2014 | |

OTHER PUBLICATIONS

Chinese Office Action with English translation and concise explanation, Chinese Patent Application No. 201580051877.6, dated Sep. 4, 2017, 12 pgs.

* cited by examiner

LIQUID DISCHARGE HEAD, AND RECORDING DEVICE USING THE SAME

TECHNICAL FIELD

The present invention relates to a liquid discharge head and a recording device including the same.

BACKGROUND ART

A conventionally known printing head is exemplified by a liquid discharge head configured to discharge liquid on a recording medium for various printing. There has been known a liquid discharge head including: a channel member provided with a discharge hole for discharge of liquid, a pressurization chamber allowing pressurization of liquid so as to be discharged from the discharge hole, and a common channel for supply of liquid to the pressurization chamber, as well as a piezoelectric actuator substrate configured to pressurize the pressurization chamber and stacked on the channel member to close an opening of the pressurization chamber in the upper surface of the channel member. There has also been known such a liquid discharge head including a channel member provided with a dummy pressurization chamber, and a piezoelectric actuator substrate closing an opening of the dummy pressurization chamber in the upper surface of the channel member (see Patent Document 1 or the like).

RELATED ART DOCUMENT

Patent Document

Patent Document 1: JP 2014-24270 A

SUMMARY OF THE INVENTION

Problem to be Solved by the Invention

The liquid discharge head disclosed in Patent Document 1 may have leak of liquid from any damaged portion of the piezoelectric actuator substrate in the region covering the dummy pressurization chamber. Such leak of liquid causes change in channel property and variation in discharge property (a discharge amount or discharge speed), and leaked liquid causes a circuit short between electrodes provided at the piezoelectric actuator substrate.

In view of this, an object of the present invention to provide a liquid discharge head configured to achieve improvement in reliability of a dummy pressurization chamber, and a recording device including the liquid discharge head.

Means for Solving the Problem

A liquid discharge head according to the present invention includes: a channel member including a plurality of discharge holes, a plurality of pressurization chambers connected with the plurality of discharge holes, respectively, and a dummy pressurization chamber; and a substrate disposed on the channel member and including a plurality of pressurizing parts configured to pressurize the plurality of pressurization chambers, respectively. The channel member includes a plurality of stacked plates, and the plurality of plates includes a pressurization chamber plate and a dummy pressurization chamber plate, the pressurization chamber plate has a hole or a groove, the hole or the groove has a side surface configuring a side surface of the pressurization chamber, and the hole or the groove has an opening configuring an opening of the pressurization chamber, the dummy pressurization chamber plate has a hole or a groove, the hole or the groove has a side surface configuring a side surface of the dummy pressurization chamber, and the hole or the groove has an opening configuring an opening of the dummy pressurization chamber, and the plurality of openings of the pressurization chambers is closed by the substrate, and the opening of the dummy pressurization chamber is closed by the pressurization chamber plate or a remaining one of the plates.

A liquid discharge head according to the present invention also includes: a channel member including a plurality of discharge holes, a plurality of pressurization chambers connected with the plurality of discharge holes, respectively, and a dummy pressurization chamber; and a substrate disposed on the channel member and including a plurality of pressurizing parts configured to pressurize the plurality of pressurization chambers, respectively. The channel member includes a plurality of stacked plates, and the plurality of plates includes a pressurization chamber plate, the pressurization chamber plate has a hole or a groove, the hole or the groove has a side surface configuring a side surface of the pressurization chamber, and the hole or the groove has an opening configuring an opening of the pressurization chamber, the plurality of openings of the pressurization chambers is closed by the substrate, and the dummy pressurization chamber is configured by a groove provided at the pressurization chamber plate in a surface not facing the substrate, and a remaining one of the plates closing the groove.

In addition, a recording device according to the present invention includes the liquid discharge head, a conveyor configured to convey a recording medium relatively to the liquid discharge head, and a controller configured to control the liquid discharge head.

Effect of the Invention

The liquid discharge head according to the present invention achieves improvement in reliability of the dummy pressurization chamber.

EMBODIMENTS FOR CARRYING OUT THE INVENTION

Figure 1A:
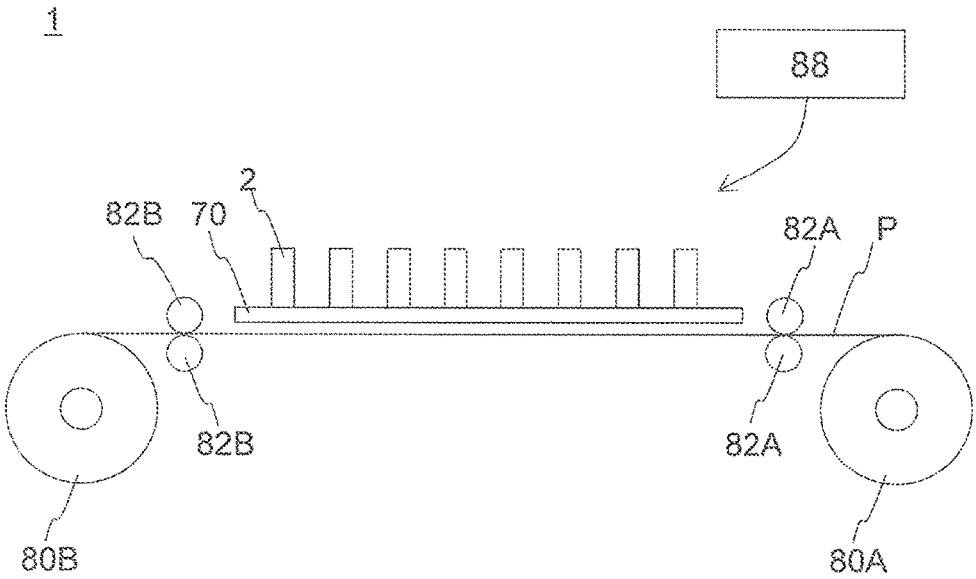
FIG. 1(*a*) is a side view of a recording device including a liquid discharge head according to an embodiment of the present invention, and FIG. 1(*b*) is a plan view thereof.
Figure 1B:
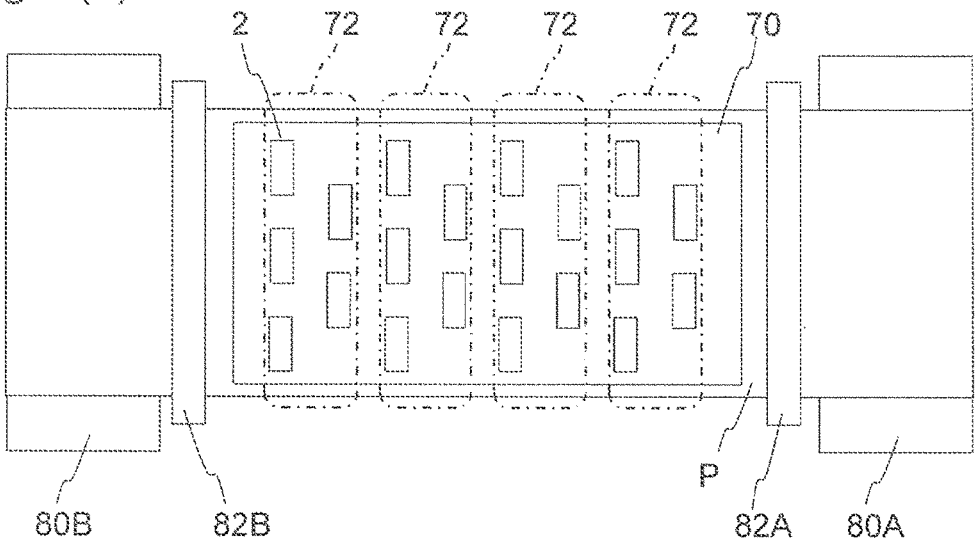

FIG. 1(*a*) is a schematic side view of a color ink jet printer (hereinafter, also simply called a printer) functioning as a recording device including a liquid discharge head 2 according to an embodiment of the present invention, and FIG. 1(*b*) is a schematic plan view thereof. The printer 1 conveys printing paper P serving as a recording medium from a guide roller 82A to a convey roller 82B to shift the printing paper P relatively to the liquid discharge head 2. A controller 88 controls the liquid discharge head 2 in accordance with image data or character data to cause the liquid discharge head 2 to discharge liquid to the printing paper P and allow liquid droplets to reach the printing paper P for recording by means of printing or the like on the printing paper P.

The liquid discharge head 2 according to the present embodiment is fixed to the printer 1, which is configured as a so-called line printer. A recording device according to another embodiment of the present invention is exemplified by a so-called serial printer configured to alternately perform shifting of a liquid discharge head 2 reciprocally or the like in a direction crossing a direction of conveying a printing paper P, such as a direction substantially perpendicular thereto, and conveying of the printing paper P.

The printer 1 includes a flat head mount frame 70 (hereinafter, also simply called a frame) disposed substantially in parallel with the printing paper P and fixed to the printer 1. The frame 70 is provided with 20 holes (not depicted), and 20 liquid discharge heads 2 are mounted at the holes, respectively. The liquid discharge heads 2 each have a portion that is configured to discharge liquid and faces the printing paper P. The liquid discharge heads 2 are distant from the printing paper P by about 0.5 to 20 mm. Five liquid discharge heads 2 configure a single head group 72, and the printer 1 includes four head groups 72.

The liquid discharge heads 2 each have an elongating shape extending from the front toward the back in FIG. 1(*a*), or in the vertical direction in FIG. 1(*b*). The extending direction will also be called a longitudinal direction. In each one of the head groups 72, three of the liquid discharge heads 2 are aligned in a direction crossing the direction of conveying the printing paper P, such as a substantially perpendicular direction, whereas the remaining two liquid discharge heads 2 are displaced in the conveying direction to be aligned at positions between adjacent ones of the three liquid discharge heads 2. The liquid discharge heads 2 have printable ranges disposed continuously or disposed to have ends overlapped with each other in the width direction of the printing paper P (in a direction crossing the direction of conveying the printing paper P) to enable gapless printing in the width direction of the printing paper P.

The four head groups 72 are disposed in the direction of conveying the printing paper P. The liquid discharge heads 2 are each supplied with liquid such as ink from a liquid tank (not depicted). The liquid discharge heads 2 belonging to each one of the head groups 72 are supplied with an ink in one color, and the four head groups 72 enable printing in four colors. The head groups 72 discharge inks in magenta (M), yellow (Y), cyan (C), and black (K), for example. The controller 88 controls printing with these inks to enable printing a color image.

The printer 1 can be mounted with only one liquid discharge head 2 in order for printing in one color in a range printable with the single liquid discharge head 2. The number of liquid discharge heads 2 included in each of the head groups 72 and the number of head groups 72 are variable appropriately in accordance with a printing target or a printing condition. For example, the number of head groups 72 can be increased for printing in more colors. Disposing a plurality of head groups 72 for printing in an identical color and printing alternately in the conveying direction will achieve increase in conveying speed even with use of the liquid discharge heads 2 of the same performance. This increases a printing area per unit time. Disposing a plurality of head groups 72 for printing in an identical color to be displaced in a direction crossing the conveying direction will achieve higher resolution in the width direction of the printing paper P.

In addition, instead of colored ink, liquid such as a coating agent can be printed for surface treatment of the printing paper P.

In printing, the printer 1 prints on the printing paper P serving as a recording medium. The printing paper P, which is wound around a paper feed roller 80A, passes between two guide rollers 82A, below the liquid discharge heads 2 mounted on the frame 70, and then between two convey rollers 82B, and is finally collected by a collect roller 80B. The convey rollers 82B are rotated to convey the printing paper P at constant speed and printing is performed with the liquid discharge heads 2. The collect roller 80B winds the printing paper P conveyed from the convey rollers 82B. The printing paper P is conveyed at a speed of 50 m/min or the like. The rollers can be controlled by the controller 88 or can be operated manually by a person.

Examples of the recording medium include, in addition to the printing paper P, wound cloth. The printer 1 can also be configured to, instead of directly conveying the printing paper P, directly convey a conveyor belt provided thereon with the recording medium. Examples of the recording medium in such a configuration include a sheet of paper, cut cloth, wood, and tile. The liquid discharge head 2 can alternatively be configured to discharge liquid containing conductive particles for printing a wiring pattern of an electronic device or the like. The liquid discharge head 2 can still alternatively be configured to discharge a predetermined amount of a liquid chemical agent or liquid containing a chemical agent to a reactor vessel or the like for reaction of producing a chemical product.

The printer 1 is optionally provided with a position sensor, a speed sensor, a temperature sensor, or the like, and the controller 88 can control each unit of the printer 1 in accordance with a status of the unit of the printer 1 based on information from the sensor. For example, in a case where temperature of the liquid discharge head 2 or liquid in the liquid tank, pressure applied from the liquid in the liquid tank to the liquid discharge head 2, or the like influences a discharge property (e.g. a discharge amount or discharge speed) of the discharged liquid, a different driving signal for discharge of the liquid can be transmitted in accordance with the information.

Figure 2A:
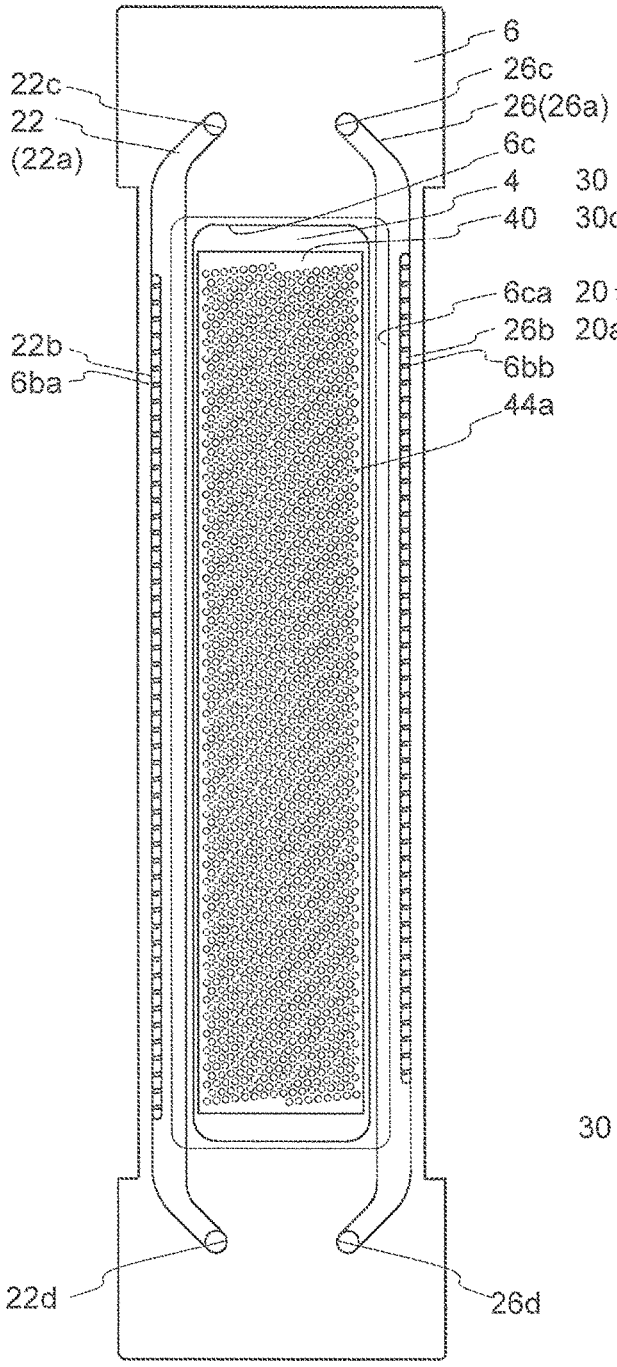
FIG. 2(*a*) is a plan view of a head body as a main part in the liquid discharge head depicted in FIGS. 1(*a*) and 1(*b*), and FIG. 2(*b*) is a plan view of the head body in a state where a second channel member is removed.
Figure 2:
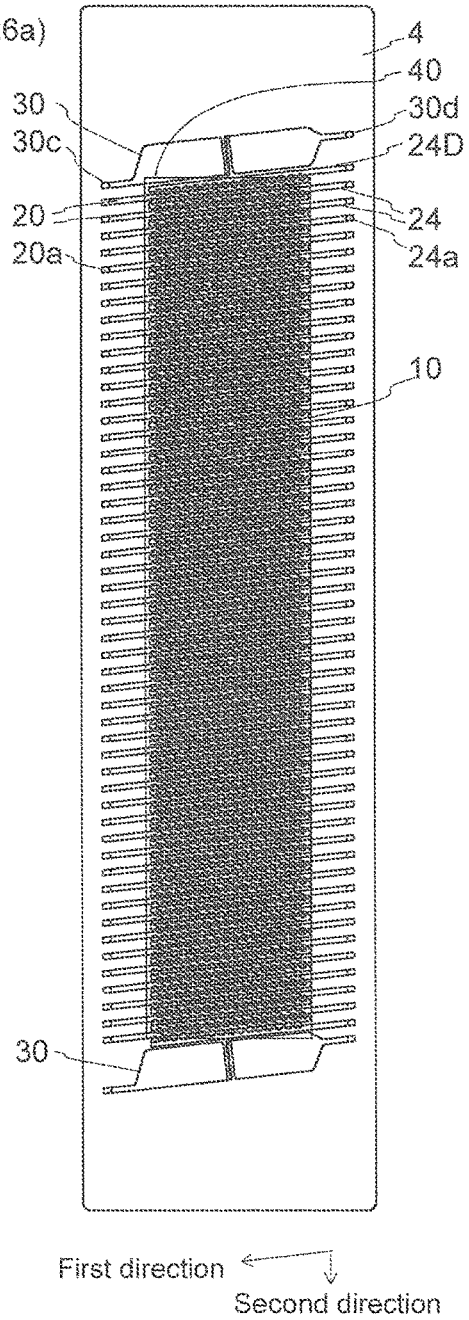
Figure 3:
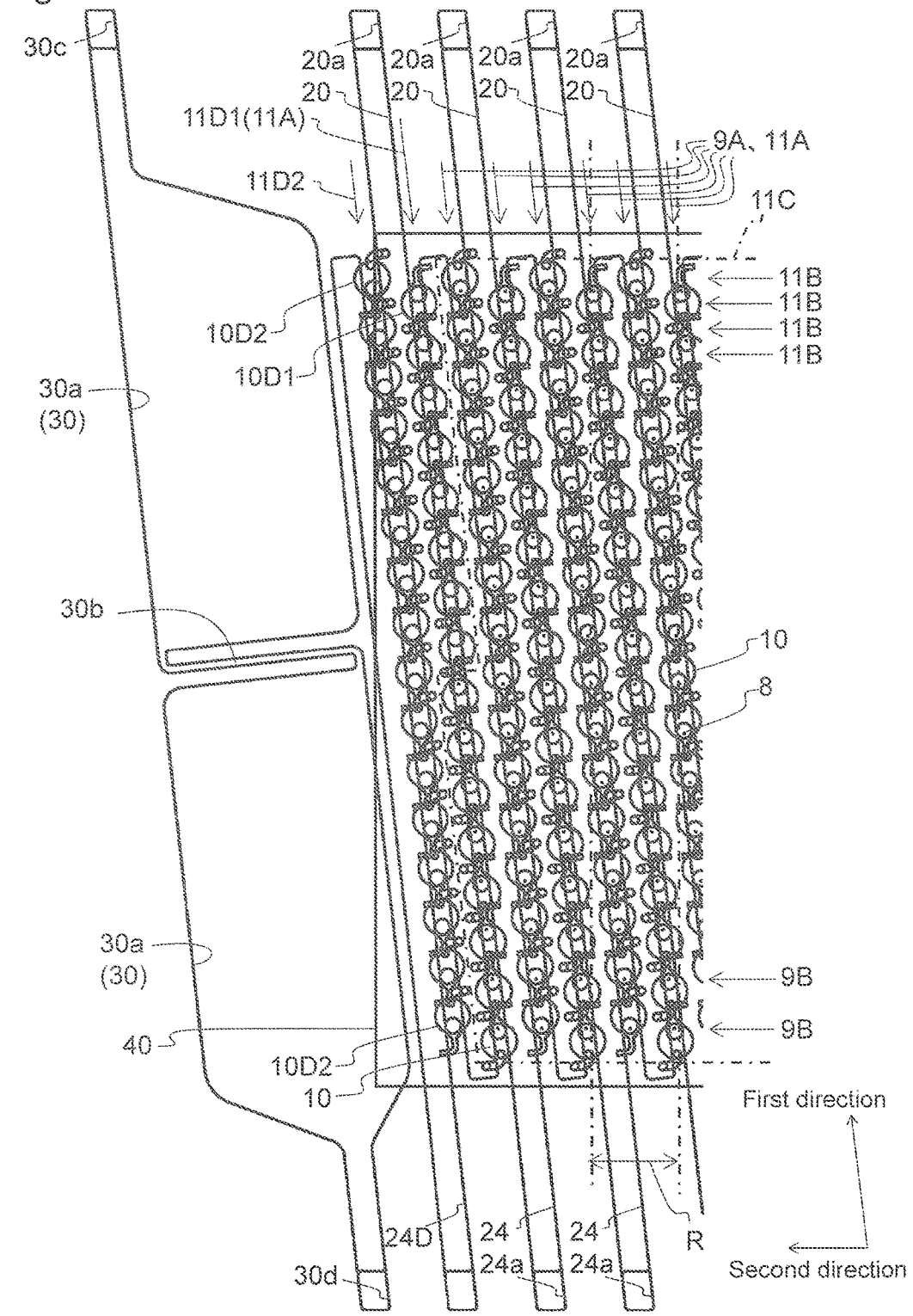
FIG. 3 is an enlarged plan view of part of the depiction in FIG. 2(*b*).
Figure 4:
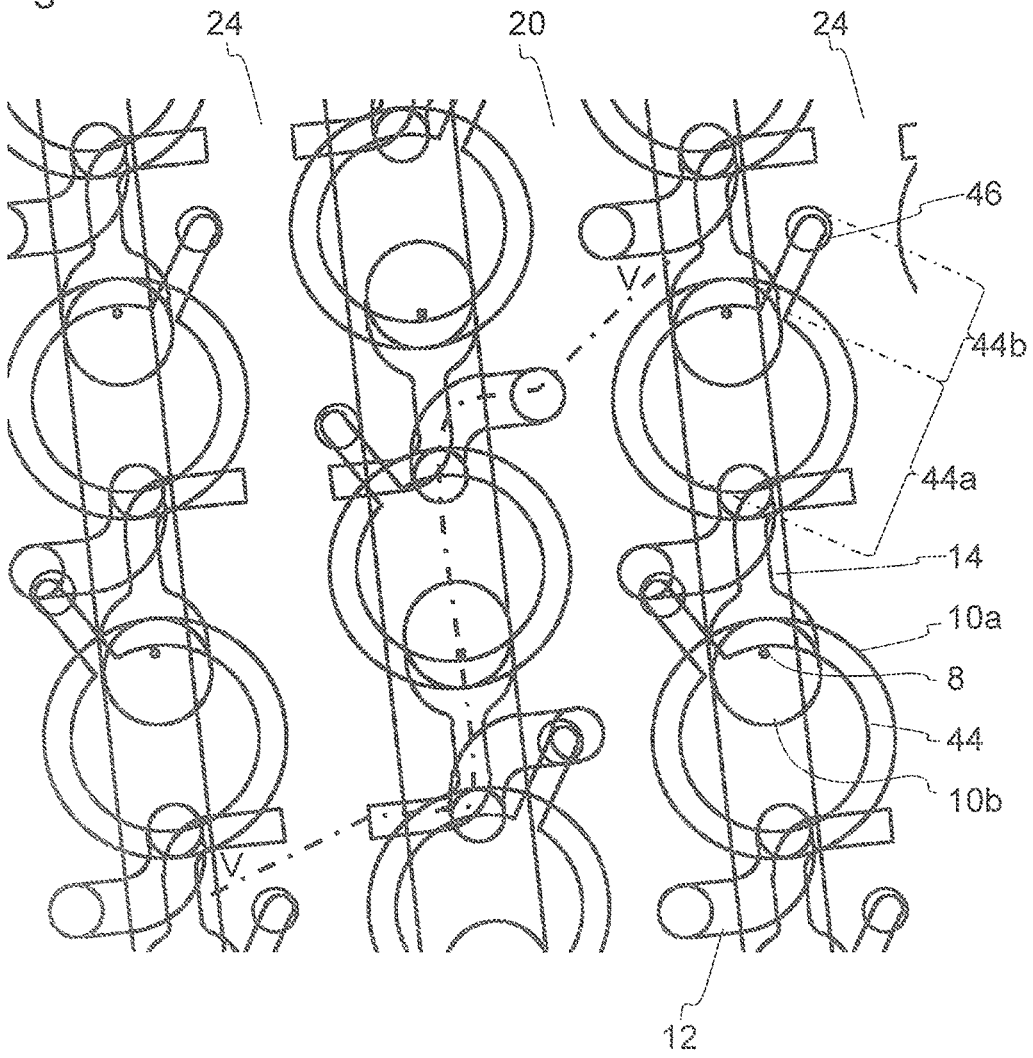
FIG. 4 is an enlarged plan view of part of the depiction in FIG. 2(*b*).
Figure 5A:
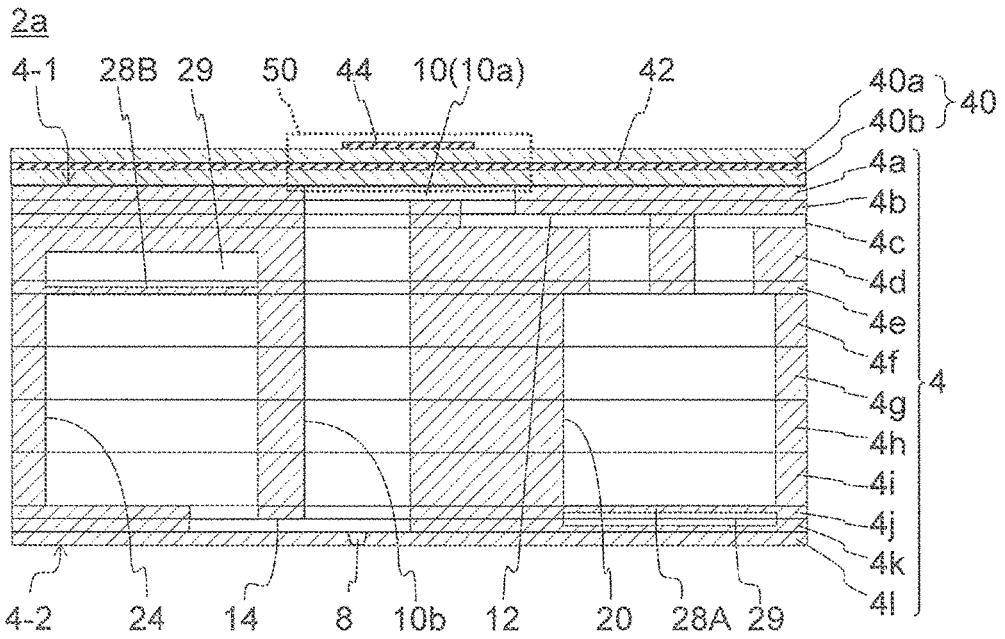
FIG. 5(*a*) is a partial longitudinal sectional view of the head body taken along line V-V indicated in FIG. 4, and FIG. 5(*b*) is a partial longitudinal sectional view of another portion of the head body.
Figure 5B:
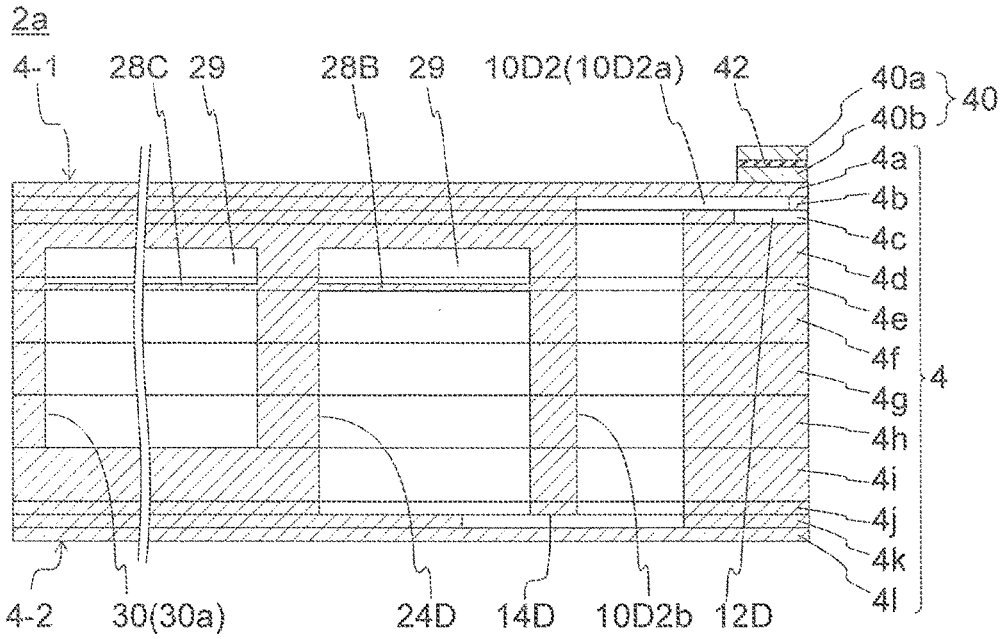
Figure 6:
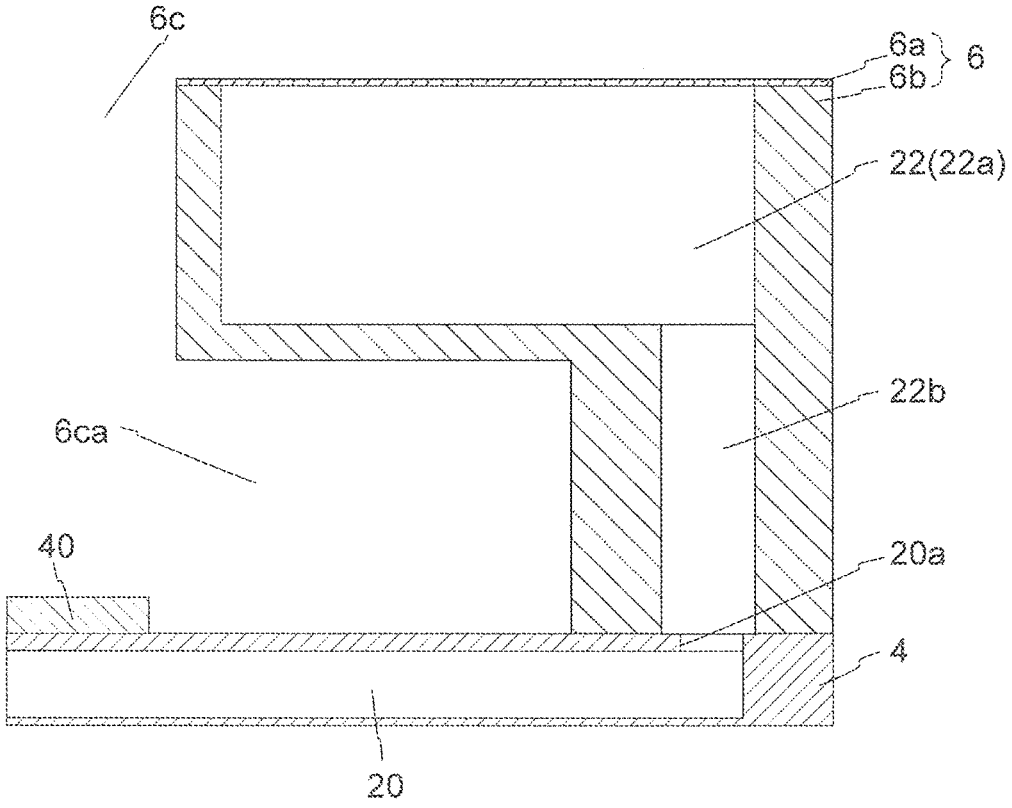
FIG. 6 is a partial longitudinal sectional view of the head body depicted in FIG. 2(*a*).

Described next is the liquid discharge head 2 according to an embodiment of the present invention. FIG. 2(*a*) is a plan view of a head body 2*a* as a main part in the liquid discharge head 2 depicted in FIGS. 1(*a*) and 1(*b*). FIG. 2(*b*) is a plan view of the head body 2*a* in a state where a second channel member 6 is removed. FIGS. 3 and 4 are enlarged plan views of the depiction in FIG. 2(*b*). FIG. 5(*a*) is a partial longitudinal sectional view taken along line V-V indicated in FIG. 4. FIG. 5(*b*) is a partial longitudinal sectional view of a first end channel 30 and the vicinity thereof in the head body 2*a*. FIG. 5(*b*) is a partial longitudinal sectional view taken along a bent line (not indicated) like line V-V. FIG. 6 is a partial longitudinal sectional view of a portion along a first common channel 20 in the vicinity of an opening 20*a* of the first common channel 20 in the head body 2*a*.

These figures depict in the following manners for more comprehensive depiction. FIGS. 2(*a*) to 4 depict channels and the like, which are disposed below other members and should be depicted with broken lines, with solid lines. FIG. 2(*a*) does not include channels in a first channel member 4, and includes a piezoelectric actuator substrate 40 by depicting only an outer shape and disposition of an individual electrode body 44*a*.

The liquid discharge head 2 can include, in addition to the head body 2*a*, a metal case, a driver IC, a circuit board, and the like. The head body 2*a* includes the first channel member 4, a second channel member 6 configured to supply the first channel member 4 with liquid, and the piezoelectric actuator substrate 40 mounted with a displacement element 50 functioning as a pressurizing part. The head body 2*a* has a tabular shape elongating in one direction, which will also be called a longitudinal direction. The second channel member 6 also serves as a support member, and the head body 2*a* is fixed to the frame 70 at both ends in the longitudinal direction of the second channel member 6.

The first channel member 4 configuring the head body 2*a* has a tabular shape and is about 0.5 to 2 mm thick. The first channel member 4 has a first main surface or a pressurization chamber surface 4-1, provided with a large number of planarly arrayed pressurization chambers 10. The first channel member 4 has a second main surface or a discharge hole surface 4-2 opposite to the pressurization chamber surface 4-1, provided with a large number of planarly arrayed discharge holes 8 for discharge of liquid. The discharge holes 8 are connected with the pressurization chambers 10, respectively. Hereinafter, assume that the pressurization chamber surface 4-1 is positioned above the discharge hole surface 4-2.

The first channel member 4 is provided with a plurality of first common channels 20 and a plurality of second common channels 24 extending in an identical direction. The direction along the first common channels 20 and the second common channels 24 corresponds to a first direction. The first common channels 20 and the second common channels 24 are aligned alternately in a second direction crossing the first direction. The second direction is in parallel with the longitudinal direction of the head body 2*a*.

The pressurization chambers 10 are arrayed along both sides of each of the first common channels 20 to configure a pressurization chamber row 11A on each of the sides, totally two pressurization chamber rows 11A. The first common channel 20 and the pressurization chamber 10 arrayed on each of the sides are connected via a first individual channel 12. Hereinafter, the first common channels 20 and the second common channels 24 may collectively be referred to as common channels. The plurality of common channels is aligned in the second direction to configure a common channel group.

The pressurization chambers 10 are arrayed along both sides of each of the second common channels 24 to configure a pressurization chamber row 11A on each of the sides, totally two pressurization chamber rows 11A. The second common channel 24 and the pressurization chamber 10 arrayed on each of the sides are connected via a second individual channel 14 serving as an individual drain channel.

In other words, the pressurization chambers 10 are arrayed on a virtual line, the first common channel 20 extends along a first side of the virtual line and the second common channel 24 extends along a second side of the virtual line. The virtual line provided with the pressurization chambers 10 extends linearly in the present embodiment, but can alternatively be curved or bent.

In the first channel member 4 thus configured, liquid supplied to the second common channels 24 flows into the pressurization chambers 10 arrayed along the second common channels 24. Part of the liquid is discharged from the discharge holes 8 whereas another part of the liquid flows into the first common channels 20 positioned opposite to the second common channels 24 with respective to the pressurization chambers 10 and is drained out of the first channel member 4.

The second common channels 24 are disposed on the both ends of each of the first common channels 20, and the first common channels 20 are disposed on the both sides of each of the second common channels 24. This configuration is preferred for substantially halving the numbers of the first common channels 20 and the second common channels 24, in comparison to a case where one first common channel 20 and one second common channel 24 are connected to one pressurization chamber row 11A and another first common channel 20 and another second common channel 24 are connected to another pressurization chamber row 11A. The first common channels 20 and the second common channels 24 reduced in the numbers thereof achieve higher resolution with a larger number of pressurization chambers 10, less difference in discharge property of the discharge holes 8 with thicker first common channels 20 and second common channels 24, and reduction in planar size of the head body 2*a*.

Pressure applied to a portion close to the first common channel 20 of the first individual channel 12 connected with the first common channel 20 is varied due to a pressure loss, depending on the position of connection between the first common channel 20 and the first individual channel 12 (mainly the position in the first direction). Pressure applied to a portion close to the second individual channel 14 connected to the second common channel 24 is varied due to a pressure loss, depending on the position of connection between the second common channel 24 and the second individual channel 14 (mainly the position in the first direction). When the external openings 20*a* of the first common channels 20 are disposed at a first end in the first direction and external openings 24*a* of the second common channels 24 are disposed at a second end in the first direction, pressure differences due to disposition of the first individual channels 12 and the second individual channels 14 are cancelled with each other to reduce differences in pressure applied to the discharge holes 8. The openings 20*a* of the first common channels 20 as well as the openings 24*a* of the second common channels 24 are opened in the pressurization chamber surface 4-1.

The discharge holes 8 not in a discharge state each hold a liquid meniscus. Liquid in the discharge holes 8 has negative pressure (in a state of being drawn into the first channel member 4), which is balanced with surface tension of the liquid to hold meniscuses. Liquid surface tension is likely to reduce a liquid surface area. A meniscus is held even with positive pressure if the pressure is low. Liquid overflows with high positive pressure and is drawn into the first channel member 4 with high negative pressure. The liquid is not kept in a dischargeable state in both cases. It is thus necessary to avoid excessively large differences, among the discharge holes 8, in liquid pressure in the discharge holes 8 when the liquid flows from the second common channels 24 to the first common channels 20.

The first common channels 20 each have a wall surface that is close to the discharge hole surface 4-2 and serves as a first damper 28A. The first damper 28A has a first surface facing the first common channel 20 and a second surface facing a damper chamber 29. Provision of the damper chamber 29 enables deformation of the first damper 28A, and the first damper 28A is deformed to vary the volume of the first common channel 20. When liquid in the pressurization chamber 10 is pressurized to be discharged, the pressure is partially transmitted to the first common channel 20 via the liquid. The liquid in the first common channel 20 may thus vibrate, and the vibration may be transmitted to the originated pressurization chamber 10 or a different pressurization chamber 10 to generate fluid crosstalk that causes variation in liquid discharge property. When the first damper 28A is provided, liquid vibration transmitted to the first common channel 20 vibrates the first damper 28A and is attenuated to be unlikely to keep liquid vibration in the first common channel 20 and thus reduces influence of the fluid crosstalk. The first damper 28A also has a function of stabilizing supply and drain of liquid.

The second common channels 24 each have a wall surface that is close to the pressurization chamber surface 4-1 and serves as a second damper 28B. The second damper 28B has a first surface facing the second common channel 24 and a second surface facing a damper chamber 29. Similar to the first damper 28A, the second damper 28B reduces influence of fluid crosstalk. The second damper 28B also has a function of stabilizing supply and drain of liquid.

Each of the pressurization chambers 10 is disposed to face the pressurization chamber surface 4-1, and is a hollow region including a pressurization chamber body 10*a* to receive pressure from the displacement element 50, and a descender 10*b* as a partial channel connected from the bottom of the pressurization chamber body 10*a* to the discharge hole 8 opened in the discharge hole surface 4-2. The pressurization chamber body 10*a* has a right circular cylinder shape and a planarly circular shape. The planarly circular shape enables increase in displacement amount of the displacement element 50 deformed with equal force, and in volume variation of the pressurization chamber 10 caused by the displacement. The descender 10*b* has a right circular cylinder shape smaller in diameter than the pressurization chamber body 10*a*, and has a circular sectional shape. The descender 10*b* is accommodated in the pressurization chamber body 10*a* when viewed from the pressurization chamber surface 4-1.

The plurality of pressurization chambers 10 is disposed in a zigzag form on the pressurization chamber surface 4-1. The plurality of pressurization chambers 10 configures a plurality of pressurization chamber rows 11A extending in the first direction. The pressurization chambers 10 are aligned at substantially equal intervals in each of the pressurization chamber rows 11A. The pressurization chambers 10 belonging to the adjacent pressurization chamber rows 11A are displaced in the first direction by about a half of the interval. In other words, each of the pressurization chambers 10 belonging to one of the pressurization chamber rows 11A is positioned substantially at the center in the first direction of the two consecutive pressurization chambers 10 belonging to each of the adjacent pressurization chamber rows 11A.

The pressurization chambers 10 belonging to every other pressurization chamber row 11A are thus arrayed in the second direction to configure pressurization chamber lines 11B.

The first channel member 4 is further provided with a first dummy pressurization chamber 10D1 and a second dummy pressurization chamber 10D2. The first dummy pressurization chamber 10D1 and the second dummy pressurization chamber 10D2 may collectively be called dummy pressurization chambers. The first dummy pressurization chamber 10D1 and the second dummy pressurization chamber 10D2 will be detailed later.

According to the present embodiment, there are 51 first common channels 20, 50 second common channels 24, and 100 pressurization chamber rows 11A. Note that these pressurization chamber rows 11A do not include a dummy pressurization chamber row 11D provided only with dummy pressurization chambers to be described later. Furthermore, these second common channels 24 do not include the second common channel 24 directly connected only with the dummy pressurization chamber. The pressurization chamber rows 11A each include 16 pressurization chambers 10. The pressurization chamber row 11A positioned at an end in the second direction includes eight pressurization chambers 10 and eight dummy pressurization chambers. The pressurization chambers 10 are disposed in the zigzag form as described above, so that there are 32 pressurization chamber lines 11B.

The plurality of pressurization chambers 10 is arrayed in a grid form in the first direction and the second direction on the discharge hole surface 4-2. The plurality of discharge holes 8 configures a plurality of discharge hole rows 9A extending in the first direction. The discharge hole rows 9A and the pressurization chamber rows 11A are disposed at substantially identical positions.

The pressurization chambers 10 each have an area centroid displaced in the first direction from the discharge hole 8 connected with the pressurization chamber 10. One of the pressurization chamber rows 11A has an identical displacement direction whereas the pressurization chamber rows 11A adjacent thereto have a displacement direction opposite thereto. The discharge holes 8 connected with the pressurization chambers 10 belonging to two pressurization chamber lines 11B thus configure one discharge hole line 9B disposed in the second direction.

According to the present invention, there are thus 100 discharge hole rows 9A and 16 discharge hole lines 9B.

The pressurization chamber bodies 10*a* each have an area centroid displaced substantially in the first direction from the discharge hole 8 connected with the pressurization chamber body 10*a*. The descenders 10*b* are each displaced from the pressurization chamber body 10*a* toward the discharge hole 8. Each of the pressurization chamber bodies 10*a* has a side wall in contact with a side wall of the descender 10*b*, to be unlikely to cause liquid retention in the pressurization chamber body 10*a*.

Each of the discharge holes is disposed in a center portion of the descender 10*b*. The center portion corresponds to a region within a circle having the center disposed at the area centroid of the descender 10*b* and a diameter of a half of the diameter of the descender 10*b*.

Each of the first individual channels 12 is connected with the pressurization chamber body 10*a* at a position opposite to the descender 10*b* with respect to the area centroid of the pressurization chamber body 10*a*. Liquid flowing from the descender 10*b* thus expands in the entire pressurization chamber body 10*a* and then flows toward the first individual channel 12, with less liquid retention in the pressurization chamber body 10*a*.

Each of the second individual channels 14 is planarly extracted from a surface close to the discharge hole surface 4-2 of the descender 10*b* and is connected with the second common channel 24. The direction of extraction is identical with the displacement direction of the descender 10*b* with respect to the pressurization chamber body 10*a*.

The first direction and the second direction form an angle slanted from a right angle. The discharge holes 8 belonging to the discharge hole row 9A disposed in the first direction are thus slanted in the second direction by the angle slanted from the right angle. The discharge hole rows 9A are aligned in the second direction, so that the discharge holes 8 belonging to different discharge hole rows 9A are slanted in the second direction by the slanted angle. The discharge holes 8 in the first channel member 4 are thus aligned at constant intervals in the second direction to enable printing filling a predetermined range with pixels formed by discharged liquid.

The discharge holes 8 belonging to one discharge hole row 9A and aligned completely linearly in the first direction enable printing filling the predetermined range as described above. By such disposition, printing accuracy is largely affected by the difference between a direction perpendicular to the second direction and the conveying direction, which is caused upon installing the liquid discharge head 2 in the printer 1. It is thus preferred to replace the discharge holes 8 between the adjacent discharge hole rows 9A from the above linearly aligned discharge holes 8.

The discharge holes 8 according to the present embodiment are disposed in the following manner. In FIG. 3, when the discharge holes 8 are projected in a direction perpendicular to the second direction, the range of a virtual straight line R includes 32 discharge holes 8 arrayed at an interval of 360 dpi. This configuration achieves printing of the resolution of 360 dpi on the printing paper P conveyed in a direction perpendicular to the virtual straight line R. Projected in the range of the virtual straight line R are all of (16) the discharge holes 8 belonging to one discharge hole row 9A and a half of (8) discharge holes 8 belonging to each of the two discharge hole rows 9A adjacent to this discharge hole row 9A. The discharge holes 8 are aligned at an interval of 22.5 dpi in each of the discharge hole lines 9B to achieve such a configuration. It is because 360/16=22.5 is established.

The first common channels 20 and the second common channels 24 extend linearly in a range where the discharge holes 8 are aligned linearly, and are displaced parallelly between the discharge holes 8 displaced from the linear arrangement. The first common channels 20 and the second common channels 24 have small displaced portions and thus have small channel resistance. The parallelly displaced portion is disposed at a position not overlapped with the pressurization chambers 10, to achieve small variation in discharge property among the pressurization chambers 10.

One pressurization chamber row 11A at each end (i.e. totally two rows) in the second direction includes the normal pressurization chamber 10 and the first dummy pressurization chamber 10D1. This pressurization chamber row 11A may thus be called a dummy pressurization chamber row 11D1. The second dummy pressurization chambers 10D2 are aligned outside the dummy pressurization chamber row 11D1. There is disposed one second dummy pressurization chamber row 11D2 at each end, totally two rows at the both ends. The channel at each end, i.e. totally two channels, in the second direction each configure a dummy second common channel 24D that is shaped identically with the second common channel 24 and is connected only with the second dummy pressurization chambers 10D2 with no direct connection with the pressurization chambers 10. The dummy second common channel 24D will hereinafter be referred to as a second end channel.

The entire pressurization chambers 10 configure a pressurization chamber group 11C. The pressurization chamber group 11C entirely has a rectangular shape extending in the second direction. The pressurization chamber rows 11A extend diagonally with respect to the second direction, and the pressurization chambers 10 configure a half of the pressurization chamber row 11A at an end in the second direction. The pressurization chamber group 11C is thus shaped to have two triangular projections extending in the second direction at the both ends in the second direction. The first dummy pressurization chamber 10D1 and the second dummy pressurization chamber 10D2 are disposed outside the pressurization chamber group 11C. The dummy pressurization chambers according to the present embodiment are disposed only outside in the second direction, but can alternatively be disposed outside in a different direction such as the first direction.

The first channel member 4 has the first end channel 30 that is positioned outside, in the second direction, the common channel group including the first common channels 20 and the second common channels 24, and extends in the first direction. The first end channel 30 connects an opening 30*c* disposed further outside the openings 20*a* of the first common channels 20 aligned on the pressurization chamber surface 4-1 and an opening 30*d* disposed further outside the openings 24*a* of the second common channels 24 aligned on the pressurization chamber surface 4-1. The first end channel 30 is smaller in channel resistance than the first common channels 20 and the second common channels 24. The first end channel 30 will be detailed later.

The second channel member 6 is joined to the pressurization chamber surface 4-1 of the first channel member 4. The second channel member 6 has a second integrated channel 26 for supply of liquid to the second common channels 24, and a first integrated channel 22 for collection of liquid from the first common channels 20. The second channel member 6 is thicker than the first channel member 4 and is about 5 to 30 mm thick.

The second channel member 6 is joined to a region not connected with the piezoelectric actuator substrate 40 in the pressurization chamber surface 4-1 of the first channel member 4. More specifically, the second channel member 6 is joined to surround the piezoelectric actuator substrate 40. This configuration inhibits discharged liquid from partially adhering as mist to the piezoelectric actuator substrate 40. The first channel member 4 is fixed on the outer periphery thereof, and is thus prevented from vibrating along with the driven displacement element 50 and generating sympathetic vibration or the like.

The second channel member 6 is provided, in a center portion, with a vertical through hole 6*c*. The through hole 6*c* allows a wiring member such as a flexible printed circuit (FPC) configured to transmit a driving signal for drive of the piezoelectric actuator substrate 40, to penetrate. The through hole 6*c* is provided, close to the first channel member 4, with a widened portion 6*ca* enlarged in width in the transverse direction. The wiring member extending to the both sides in the transverse direction from the piezoelectric actuator substrate 40 is bent at the widened portion 6*ca* to be directed upward and penetrate the through hole 6*c*. The through hole has a projection to expand to the widened portion 6*ca*. The projection preferably has an R shape so as not to damage the wiring member.

The first integrated channel 22 is disposed at the second channel member 6 that is provided separately from and is thicker than the first channel member 4. This configuration achieves increase in sectional area of the first integrated channel 22 and thus achieves decrease in pressure loss difference due to positional differences of connection between the first integrated channel 22 and the first common channels 20. Channel resistance of the first integrated channel 22 is preferred to be not more than 1/100 of the channel resistance of the first common channel 20. The channel resistance of the first integrated channel 22 herein corresponds more precisely to channel resistance of the first integrated channel 22 in the range connected with the first common channel 20.

The second integrated channel 26 is disposed at the second channel member 6 that is provided separately from and is thicker than the first channel member 4. This configuration achieves increase in sectional area of the second integrated channel 26 and thus achieves decrease in pressure loss difference due to positional differences of connection between the second integrated channel 26 and the second common channels 24. Channel resistance of the second integrated channel 26 is preferred to be not more than 1/100 of the channel resistance of the second common channel 24. The channel resistance of the second integrated channel 26 herein corresponds more precisely to channel resistance of the second integrated channel 26 in the range connected with the first integrated channel 22, respectively.

The first integrated channel 22 is disposed at a first end in the transverse direction of the second channel member 6, the second integrated channel 26 is disposed at a second end in the transverse direction of the second channel member 6, and these channels extend toward the first channel member 4 to be connected with the first common channels 20 and the second common channels 24. Such a structure achieves increase in sectional area as well as decrease in channel resistance of the first integrated channel 22 and the second integrated channel 26. Furthermore, the outer periphery of the first channel member 4 is fixed by the second channel member 6 in the structure, for higher rigidity. The structure also enables provision of the through hole 6*c* through which a signal transmitter is provided.

The second channel member 6 is made of stacked plates 6*a* and 6*b* for a second channel member. The plate 6*b* is provided, on an upper surface, with a groove configuring a first integrated channel body 22*a* as a portion extending in the second direction and having low channel resistance in the first integrated channel 22, and a groove configuring a second integrated channel body 26*a* as a portion extending in the second direction and having low channel resistance in the second integrated channel 26.

A plurality of first connection channels 22*b* extends downward (toward the first channel member 4) from the groove configuring the first integrated channel body 22*a*, and is connected with the openings 20*a* of the first common channels opened in the pressurization chamber surface 4-1. The first connection channels 22*b* adjacent to each other are provided therebetween with a partition 6*ba* (in other words, the first connection channels 22*b* are branched at portions close to the first common channels 20). This configuration increases connection rigidity between the second channel member 6 and the first channel member 4. Furthermore, the partitions 6*ba* are longer than the first connection channels 22*b* in the second direction, for higher connection rigidity between the second channel member 6 and the first channel member 4.

A plurality of second connection channels 26*b* extends downward (toward the first channel member 4) from the groove configuring the second integrated channel body 26*a*, and is connected with the openings 24*a* of the second common channels opened in the pressurization chamber surface 4-1. The second connection channels 26*b* adjacent to each other are provided therebetween with a partition 6*bb* (in other words, the second connection channels 26*b* are branched at portions close to the second common channels 24). This configuration increases connection rigidity between the second channel member 6 and the first channel member 4. Furthermore, the partitions 6*bb* are longer than the second connection channels 26*b* in the second direction, for higher connection rigidity between the second channel member 6 and the first channel member 4.

The plate 6*a* is provided, at the both ends in the second direction of the first integrated channel 22, with openings 22*c* and 22*d*, respectively. The plate 6*a* is provided, at the both ends in the second direction of the second integrated channel 26, with openings 26*c* and 26*d*, respectively. In order to supply liquid to the liquid discharge head 2 containing no liquid, the liquid is supplied from a first one of the openings (e.g. the opening 26*c*) to the first channel member 4 so that the liquid in the second integrated channel 26 is likely to be drained to outside, and air and overflowed liquid are drained from a second one of the openings (e.g. the opening 26*d*) so that gas is unlikely to enter the first channel member 4. The first integrated channel 22 can similarly be configured to allow liquid to be supplied from a first one of the openings (e.g. the opening 22*c*) and to be drained from a second one of the openings (e.g. the opening 22*d*).

There are several methods of supplying and collecting liquid for printing. According to one of the methods, entire liquid supplied to the second integrated channel 26 enters the first channel member 4 and then the first integrated channel 22 and is drained to outside. The first integrated channel 22 is not supplied with external liquid in this case. Applicable to this case are a method of supplying liquid from the two openings 26*c* and 26*d* and collecting liquid from the two openings 22*c* and 22*d*, and a method of supplying liquid from a first one of the openings 26*c* and 26*d* with a second one being kept closed and collecting liquid from a first one of the openings 22*c* and 22*d* with a second one being kept closed. There are four methods in total as the openings to be used are selectable in each of the cases. Supplying from two openings and collecting from two openings are preferred for reduction in pressure difference due to a pressure loss. This, however, complicates connection of tubes for supply and drain of liquid as well as pressure control. Supplying from one opening and collecting from one opening achieve simplified connection and facilitated pressure control. In this case, liquid is preferably supplied and collected with paired openings opposing in the second direction for cancellation of pressure loss influence. Specifically, liquid can be supplied from the opening 26*c* and be collected from the opening 22*d*, or can be supplied from the opening 26*d* and be collected from the opening 22*c*.

According to another supplying and draining method, liquid is supplied from a first one of the openings (e.g. the opening 26*c*) of the second integrated channel 26 and is collected from a second one of the openings (e.g. the opening 26*d*), and liquid is supplied from a first one of the openings (e.g. the opening 22*d*) of the first integrated channel 22 and is collected from a second one of the openings (e.g. the opening 22*c*). When pressure of the second integrated channel 26 is made higher than pressure of the first integrated channel 22 by adjusting pressure of supply and pressure of drain, liquid flows to the first channel member 4. This method minimizes differences in pressure applied to the meniscuses of the discharge holes 8 among the methods described above.

The above methods can be combined such that liquid is supplied to and drained from the second integrated channel 26 and is only collected from the first integrated channel 22.

In contrast, liquid can be only supplied to the second integrated channel 26 and be supplied to and drained from the first integrated channel 22.

Furthermore, the above relations between supply and collection can be inverted. For example, liquid can be supplied from the opening 26*c* of the first integrated channel 22 with the opening 22*d* being closed and be collected from the opening 26*d* of the second integrated channel 26 with the opening 22*c* being closed.

The first integrated channel 22 and the second integrated channel 26 can each be provided with a damper for stable supply or drain of liquid regardless of variation in amount of discharged liquid. The first integrated channel 22 and the second integrated channel 26 can each be provided therein with a filter to allow less foreign matter or bubbles to enter the first channel member 4.

The piezoelectric actuator substrate 40 including the displacement element 50 is joined to the pressurization chamber surface 4-1 or the upper surface of the first channel member 4, and the displacement element 50 is disposed on each of the pressurization chambers 10. The piezoelectric actuator substrate 40 occupies a region in a substantially same shape as that of a pressurization chamber group including the pressurization chambers 10. The pressurization chambers 10 each have an opening closed by the piezoelectric actuator substrate 40 joined to the pressurization chamber surface 4-1 of the channel member 4. The piezoelectric actuator substrate 40 has a rectangular shape elongating in the direction identical to the head body 2*a*. The piezoelectric actuator substrate 40 is connected with a signal transmitter such as an FPC configured to supply each of the displacement elements 50 with a signal. The second channel member 6 is provided, at the center, with the vertically penetrating through hole 6*c*. The signal transmitter penetrates the through hole 6*c* and is electrically connected with the controller 88. The signal transmitter is preferred to have a shape extending in the transverse direction from a first long side end toward a second long side end of the piezoelectric actuator substrate 40, and be provided with wiring extending in the transverse direction to be aligned in the longitudinal direction, so as to enable the wiring to be largely distant from each other.

The piezoelectric actuator substrate 40 is provided with individual electrodes 44, at positions facing the pressurization chambers 10 on the upper surface.

The channel member 4 has a stacked structure including a plurality of stacked plates. The channel member 4 includes twelve plates 4*a* to 4*l* stacked in this order from the pressurization chamber surface 4-1. These plates are provided with a large number of holes and grooves. The holes and grooves can be formed by etching the respective plates made of a metal or the like. These plates are about 10 to 300 μm thick for high formation accuracy of the holes. The plates 4*f* to 4*i* have identical shapes, and can alternatively be configured as a single plate. There are provided the four plates for accurate formation of the holes. The plates are aligned and stacked to allow these holes to communicate with one another and configure channels such as the first common channels 20.

The pressurization chamber surface 4-1 of the tabular channel member 4 is provided with the opened pressurization chamber bodies 10*a* and is joined to the piezoelectric actuator substrate 40. The pressurization chamber surface 4-1 is provided with the openings 24*a* for supply of liquid to the second common channels 24 and the openings 20*a* for collection of liquid from the first common channels 20. The discharge hole surface 4-2, opposite to the pressurization chamber surface 4-1, of the channel member 4 is provided with the discharge holes 8. Another plate can be stacked on the pressurization chamber surface 4-1 to close the openings of the pressurization chamber bodies 10*a*, and the piezoelectric actuator substrate 40 can be provided thereon and joined. This configuration reduces possibility of influence of discharged liquid on the piezoelectric actuator substrate 40 for higher reliability.

The pressurization chambers 10 and the discharge holes 8 are provided as the structure for discharge of liquid. The pressurization chambers 10 each include the pressurization chamber body 10*a* facing the displacement element 50 and the descender 10*b* smaller in sectional area than the pressurization chamber body 10*a*. The pressurization chamber bodies 10*a* are provided at the plate 4*a*, and the descenders 10*b* are formed by overlapping holes provided in the plates 4*b* to 4*k* and closing (portions other than the discharge holes 8) with the nozzle plate 4*l*.

The pressurization chamber bodies 10*a* are each connected with the first individual channel 12 that is connected with the first common channel 20. The first individual channel 12 includes a circular hole penetrating the plate 4*b*, a through groove planarly extending in the plate 4*c*, and a circular hole penetrating the plate 4*d*. The first common channels 20 are formed by overlapping holes provided in the plates 4*f* to 4*i* and closing the upper end with the plate 4*e* and the lower end with the plate 4*j*.

The descenders 10*b* are each connected with the second individual channel 14 that is connected with the second common channel 24. The second individual channel 14 is a through groove planarly extending in the plate 4*j*. The second common channels 24 are formed by overlapping holes provided in the plates 4*f* to 4*i* and closing the upper end with the plate 4*e* and the lower end with the plate 4*j*.

In summary on the liquid flow, liquid supplied to the second integrated channel 26 enters each of the pressurization chambers 10 through the second common channel 24 and the second individual channel 14 in this order, and the liquid is partially discharged from the discharge hole 8. The liquid not discharged passes through the first individual channel 12, enters the first common channel 20, then enters the first integrated channel 22, and is drained out of the head body 2*a*.

The piezoelectric actuator substrate 40 has a stacked structure including two piezoelectric ceramic layers 40*a* and 40*b* made of a piezoelectric material. These piezoelectric ceramic layers 40*a* and 40*b* are about 20 μm thick. The piezoelectric actuator substrate 40 is thus about 40 μm from the upper surface of the piezoelectric ceramic layer 40*a* to the lower surface of the piezoelectric ceramic layer 40*b*. The piezoelectric ceramic layer 40*a* and the piezoelectric ceramic layer 40*b* have a thickness ratio ranging from 3:7 to 7:3, preferably ranging from 4:6 to 6:4. The both piezoelectric ceramic layers 40*a* and 40*b* extend to be provided over the plurality of pressurization chambers 10. These piezoelectric ceramic layers 40*a* and 40*b* are, for example, made of a ceramics material of a lead zirconate titanate (PZT) system, a $NaNbO_3$ system, a $BaTiO_3$ system, a $(BiNa)NbO_3$ system, a $BiNaNb_5O_{15}$ system, or the like having ferroelectricity.

The piezoelectric actuator substrate 40 has a common electrode 42 made of a metal material of an Ag—Pd system or the like, and the individual electrodes 44 made of a metal material of an Au system or the like. The common electrode 42 is about 2 μm thick whereas the individual electrodes 44 are about 1 μm thick.

The individual electrodes 44 are disposed on the upper surface of the piezoelectric actuator substrate 40 at the positions facing the pressurization chambers 10. Each of the individual electrodes 44 is slightly smaller in planar shape than the pressurization chamber body 10*a*, and includes the individual electrode body 44*a* shaped substantially similar to the pressurization chamber body 10*a* and an extraction electrode 44*b* extracted from the individual electrode body 44*a*. There is provided a connection electrode 46 at an end of the extraction electrode 44*b* in a portion extracted to outside the region facing the pressurization chamber 10. The connection electrode 46 is, for example, made of a conductive resin containing conductive particles such as silver particles, and is about 5 to 200 μm thick. The connection electrode 46 is electrically joined to an electrode provided at the signal transmitter.

The individual electrodes 44 are each supplied with a driving signal from the controller 88 via the signal transmitter, as to be detailed later. The driving signal is supplied at constant periods in synchronization with conveying speed of the printing paper P.

The common electrode 42 is provided to extend planarly substantially entirely in a region between the piezoelectric ceramic layer 40*a* and the piezoelectric ceramic layer 40*b*. In other words, the common electrode 42 extends to cover all the pressurization chambers 10 in the region facing the piezoelectric actuator substrate 40. The common electrode 42 is connected, via a through conductor penetrating the piezoelectric ceramic layer 40*a*, to a surface electrode for the common electrode (not depicted) provided on the piezoelectric ceramic layer 40*a* at a position not provided with an electrode group of the individual electrodes 44. Furthermore, the common electrode 42 is grounded via the surface electrode for the common electrode and is kept at ground potential. The surface electrode for the common electrode is connected directly or indirectly with the controller 88, similarly to the individual electrode 44.

The individual electrodes 44 of the piezoelectric ceramic layer 40*a* and the common electrode 42 interpose a portion that is polarized in the thickness direction and functions as the displacement elements 50 each having a unimorph structure and configured to be displaced when voltage is applied to the individual electrode 44. More specifically, when the individual electrodes 44 and the common electrode 42 are made different from each other in potential and the piezoelectric ceramic layer 40*a* is provided with an electric field in the polarization direction, the portion receiving the electric field functions as an active part to be warped due to a piezoelectric effect. In this configuration, when the controller 88 causes the individual electrodes 44 to have predetermined positive or negative potential relatively to the common electrode 42 so as to align the electric field and the polarization, the portion interposed between the electrodes of the piezoelectric ceramic layer 40*a* (the active part) contracts planarly. Meanwhile, the non-active piezoelectric ceramic layer 40*b* is not influenced by the electric field and thus tends to restrain deformation of the active part without active contraction of the layer. There is then caused a difference in warp in the polarization direction between the piezoelectric ceramic layer 40*a* and the piezoelectric ceramic layer 40*b*, and the piezoelectric ceramic layer 40*b* is deformed to project toward the pressurization chambers 10 (unimorph deformation).

Described next is liquid discharge behavior. Each of the displacement elements 50 is driven (displaced) in accordance with a driving signal supplied to the individual electrode 44 via the driver IC and the like by control of the controller 88. Liquid is discharged in accordance with various driving signals in the present embodiment. Described herein is a so-called pull driving method.

Each of the individual electrodes 44 is preliminarily made to higher in potential than the common electrode 42 (hereinafter, referred to as high potential), is made once equal in potential to the common electrode 42 (hereinafter, referred to as low potential) upon each discharge request, and is then made to have high potential again at predetermined timing. Accordingly, at the timing when the individual electrode 44 is made to have low potential, the piezoelectric ceramic layers 40*a* and 40*b* (start to) return to original (flat) shapes and the pressurization chamber 10 is increased in volume from an initial state (where the electrodes are different in potential). Liquid in the pressurization chamber 10 thus receives negative pressure. The liquid in the pressurization chamber 10 then starts vibrating at natural oscillation periods. Specifically, the volume of the pressurization chamber 10 starts increasing whereas the negative pressure gradually reduces initially. The volume of the pressurization chamber 10 is then maximized whereas the pressure reaches substantially zero. The volume of the pressurization chamber 10 subsequently starts decreasing whereas the voltage gradually rises. The individual electrode 44 is then made to have high potential at the timing when the pressure is substantially maximized. Initially applied vibration and subsequently applied vibration are then overlapped with each other and liquid receives higher pressure. This pressure is transmitted in the descender to cause liquid to be discharged from the discharge hole 8.

In other words, liquid droplets can be discharged by supplying the individual electrode 44 with a driving signal having a pulse with low potential for a certain period with reference to high potential. When this pulse has a width of an acoustic length (AL) as a half of the natural oscillation period of the liquid in the pressurization chamber 10, discharge speed and a discharge amount of liquid is maximized in principle. The natural oscillation period of the liquid in the pressurization chamber 10 is largely influenced by liquid physical properties and the shape of the pressurization chamber 10, and is influenced also by physical properties of the piezoelectric actuator substrate 40 and properties of the channels connected with the pressurization chamber 10.

The first dummy pressurization chamber 10D1 and the second dummy pressurization chamber 10D2 are provided at the head body 2*a* for the following reasons, for example. The first reason is to decrease the difference in liquid discharge property between the pressurization chamber 10 at an end of the pressurization chamber group 11C including the disposed pressurization chambers 10 and a different pressurization chamber 10 such as the pressurization chamber 10 disposed in a center portion of the pressurization chamber group 11C. The discharge property of each of the pressurization chambers 10 is influenced by rigidity of the channel member around the pressurization chamber 10, and is thus varied in different disposition of the peripheral pressurization chambers 10. The pressurization chamber 10 disposed at the end is provided therearound with a less number of pressurization chambers 10. Provision of a dummy pressurization chamber outside the end allows the discharge property of the pressurization chamber 10 at the end to be similar to the discharge properties of the other pressurization chambers 10.

The pressurization chambers 10 according to the present embodiment expand in the second direction, and the dummy pressurization chambers are disposed outside the pressurization chambers 10 at an end in the second direction such that the pressurization chambers 10 and the dummy pressurization chambers are disposed regularly. The pressurization chamber 10 at the end in the second direction thus has less variation in discharge property. The dummy pressurization chambers are thus configured similarly to the normal pressurization chambers 10, as a void having less rigidity than the rigidity of the peripheral channel member. The dummy pressurization chambers are not necessarily connected with a peripheral channel to be filled with liquid.

The second reason is to decrease differences in discharge property by equalizing states of liquid flowing to the first common channels 20 and the second common channels 24. In the head body 2*a*, the second common channel 24 and the adjacent first common channel 20 are connected in parallel with each other via the plurality of pressurization chambers 10. Liquid supplied to the second common channel 24 passes through any one of the plurality of pressurization chambers 10 connected to the second common channel 24 and is drained to the first common channel 20. The number of the pressurization chambers 10 connected to the common channel at an end in the second direction is typically different from the number of the pressurization chambers 10 connected to a different common channel such as a common channel disposed in a center portion in the second direction. The ranges from the openings 24*a* of the second common channels 24 to the openings 20*a* of the first common channels 20 are different from each other in channel resistance. Liquid thus flows at different flow speed in these ranges to cause variation in discharge property. The dummy pressurization chambers are connected to the common channel at the end in the second direction and allow liquid to flow as in the pressurization chambers 10 to decrease the variation. Each of the dummy pressurization chambers can be a simple channel having predetermined channel resistance for this purpose.

Both the above-mentioned merits are obtained by shaping the dummy pressurization chamber substantially identically to the normal pressurization chambers 10 and connecting the dummy pressurization chamber with a peripheral common channel to allow flow of liquid. The dummy pressurization chamber is preferred not to be connected with a nozzle 8. The dummy pressurization chamber not connected with the nozzle 8 causes no overflow of liquid or suck of the atmosphere due to an unstable meniscus at the nozzle 8.

Provision of the dummy pressurization chambers achieves the merits described above but may cause the following problems. Firstly, in a case where the dummy pressurization chambers are closed by the piezoelectric actuator substrate 40 similarly to the pressurization chambers 10 and, for example, the piezoelectric actuator substrate 40 is damaged at the portion corresponding to any one of the dummy pressurization chambers, leak of liquid changes the channel property to cause variation in discharge property and the leaked liquid causes a circuit short. The pressurization chambers 10 according to the present embodiment are provided at the plate (pressurization chamber plate) 4*a* and the upper ends of the pressurization chambers 10 are closed by the piezoelectric actuator substrate 40. Furthermore, part of the dummy pressurization chambers according to the present embodiment are provided at the plate (dummy pressurization chamber plate) 4*b* positioned below the plate 4*a* and the upper ends of the dummy pressurization chambers 10 are closed by the plate (pressurization chamber plate) 4*a*. Such a configuration decreases differences in rigidity of the peripheries of the pressurization chambers 10 and differences in state of liquid flowing to the common channels, and prevents direct contact between the dummy pressurization chambers and the piezoelectric actuator substrate 40.

The second dummy pressurization chambers 10D2 according to the present embodiment are provided at the plate (dummy pressurization chamber plate) 4*b* as described above. The first dummy pressurization chamber 10D1 is provided at the plate (pressurization chamber plate) 4*a* where the pressurization chambers are provided, to have rigidity and the channel property more similar to those of the pressurization chambers 10. All the dummy pressurization chambers, inclusive of the first dummy pressurization chamber 10D1, can alternatively be provided at the plate (dummy pressurization chamber plate) 4*b* as described above.

Secondly, the piezoelectric actuator substrate 40 is increased in size in order to close the dummy pressurization chambers, and thus needs more cost or has higher proportion defective. When the dummy pressurization chambers are closed by the plate 4*a*, the piezoelectric actuator substrate 40 is unnecessary to be sized to cover the dummy pressurization chambers. The piezoelectric actuator substrate 40 can be reduced in size by being sized not to be overlapped with part of the dummy pressurization chambers in a planar view.

The pressurization chambers 10 and the second dummy pressurization chambers 10D2 are described in more detail below in terms of their structures. The pressurization chamber body 10*a* has a side surface configured by a hole provided in the plate (pressurization chamber plate) 4*a*, and the upper end of the hole is closed by the piezoelectric actuator substrate 40. A lower end of the hole, i.e. the end not facing the stacked piezoelectric actuator substrate 40, is mostly closed by the plate (dummy pressurization chamber plate) 4*b*, and the portion not closed is connected with the descender 10*b* and the first individual channel 12. The channel disposed at the plate (dummy pressurization chamber plate) 4*b* and connected with the pressurization chamber body 10*a*, specifically, the descender 10*b* and the first individual channel 12 vertically penetrate the plate (dummy pressurization chamber plate) 4*b*, and liquid flows to shift mainly vertically. In such a configuration, even when a second dummy pressurization chamber body 10D2*a* is provided at the plate (dummy pressurization chamber plate) 4*b* immediately below the plate 4*a*, the channel resistance is changed only in accordance with a degree of decrease in length of the descender 10*b* and the first individual channel 12 provided at the plate (dummy pressurization chamber plate) 4*b* to decrease the difference in channel resistance.

The plate (dummy pressurization chamber plate) 4*b* is provided directly below the plate (pressurization chamber plate) 4*a* in the present embodiment. Another plate can alternatively be provided between the plate (pressurization chamber plate) 4*a* and the plate (dummy pressurization chamber plate) 4*b*. In such a case, there can be provided a channel that penetrates all the plates from the plate provided directly below the plate (pressurization chamber plate) 4*a* to the plate (dummy pressurization chamber plate) 4*b* and allows liquid to be supplied to and drained from the pressurization chamber 10 and shift mainly vertically.

The mainly vertical flow indicates a flow of liquid in a case where a channel positioned at the boundary between the plate 4*b* and the plate 4*a* has an area centroid not largely planarly displaced from an area centroid of a channel positioned at the boundary between the plate 4*b* and the plate 4*c*. More specifically, with respect to a diameter obtained as an arithmetical mean of a diameter of a circle equal in area to the channel positioned at the boundary between the plate 4*b* and the plate 4*a* and a diameter of a circle equal in area to the channel positioned at the boundary between the plate 4*b* and the plate 4*c*, the planar distance between the area centroids are not more than 50%, and are preferred to be not more than 30% and be particularly not more than 10%.

The second dummy pressurization chamber body 10D2*a* has a side surface configured by a hole provided in the plate (dummy pressurization chamber plate) 4*b*, and the upper end of the hole is closed by the plate 4*a*. The lower end of the hole is mostly closed by the plate 4*c*, and the portion not closed is connected with a dummy descender 10D2*b* and a dummy first individual channel 12D.

The second dummy pressurization chamber body 10D2*a* can be provided at any one of the plates positioned below the plate (pressurization chamber plate) 4*a*. In order to allow the second dummy pressurization chamber 10D2 to be more similar in terms of its peripheral structure (more specifically, rigidity and channel resistance) to the pressurization chambers 10, the second dummy pressurization chamber 10D2 is preferably disposed at the plate 4*b* provided immediately below the plate (pressurization chamber plate) 4*a*. In a case where the second dummy pressurization chamber 10D2 is disposed at the plate 4*c* or the like, the plate 4*b* closes the upper surface of the second dummy pressurization chamber 10D2.

In order to allow the second dummy pressurization chamber 10D2 to be similar in terms of its peripheral structure (more specifically, rigidity and channel resistance) to the pressurization chambers 10, the pressurization chambers 10 are preferably substantially equal in height (depth) to the second dummy pressurization chamber 10D2. In other words, the plate (dummy pressurization chamber plate) 4*b* and the plate (pressurization chamber plate) 4*a* are preferred to be substantially equal in thickness. The pressurization chamber body 10*a* and the second dummy pressurization chamber body 10D2*a* can thus have substantially equal channel resistance. Being substantially equal in thickness indicates that the thickness of one of the plates is within ±50% of the thickness of the other plate. The thickness is preferred to be within ±30% and be particularly within ±10%.

The common channels according to the present embodiment extend in the first direction substantially parallel to the transverse direction of the head body 2*a*, and are aligned in the second direction parallel to the longitudinal direction of the head body 2*a*. All the common channels configure a single common channel group. The head body 2*a* extends in the second direction to outside the common channel group, and is provided with the openings 22*c*, 22*d*, 26*c*, and 26*d* for supply and drain of liquid from and to outside. The head body 2*a* has the both ends in the second direction fixed to the printer 1.

The head body 2*a* is controlled to have constant temperature for a stable liquid discharge property. Liquid of lower viscosity achieves more stable discharge and circulation, so that temperature is basically kept not less than normal temperature. Liquid is thus basically heated, but is occasionally cooled at high environmental temperature. Described below is a case where liquid is heated relatively to environmental temperature, and the same applies to the case where liquid is cooled. If there is a difference between environmental temperature and target temperature, the head body 2*a* radiates more heat from an end in the longitudinal direction (the second direction), so that liquid in the common channel at an end in the second direction is likely to have lower temperature in the common channel group. The pressurization chamber 10 at an end in the second direction is thus different in discharge property from the other pressurization chambers 10, which may deteriorate printing accuracy.

In the head body 2*a*, the first end channel 30 is thus provided outside, in the second direction of the common channel group, the channel members (including the first channel member 4 and the second channel member 6 combined with each other). The first end channel 30 is lower in channel resistance than the common channels. The first end channel 30 has low channel resistance, so that liquid flowing to the first end channel 30 is larger in flow rate per unit time than liquid flowing to the common channels. Thus, even when the head body 2*a* radiates much heat from an end in the second direction, temperature is unlikely to be transmitted across the first end channel 30 to achieve decrease in temperature difference in the common channel group. The first end channel 30 preferably has channel resistance not less than twice, particularly not less than three times, of the channel resistance of the common channel.

The channel resistance of the common channel corresponds to channel resistance from an opening 24*b* of one second common channel 24 to the opening 20*a* of one first common channel 20. According to the present embodiment, liquid supplied to one second common channel 24 flows into the pressurization chambers in two pressurization chamber rows 11A and further flows into two first common channels 20. In contrast, one first common channel 20 receives liquid from two second common channels 24. According to this relation, channel resistance of the common channel is equal to channel resistance of a case where liquid supplied to one second common channel 24 flows into the pressurization chambers in two pressurization chamber rows 11A and further to the channel having channel resistance twice the channel resistance of the first common channel 20. In other words, assuming that the first common channel 20 has channel resistance RA, the second common channel 24 has channel resistance RB, and the individual channel has channel resistance RI, the channel resistance of the common channel is expressed as RB+(RI/16+RA×2)/2. This expression is calculated to obtain RA+RB+RI/32. Specifically, the channel resistance of the common channel is calculated as the sum of the channel resistance of the first common channel 20, the channel resistance of the second common channel 24, and the channel resistance of a case where the individual channels of two pressurization chamber rows 11A are provided in parallel with each other.

The first end channel 30 is provided at each end of the common channel group in the present embodiment. The first end channel 30 is preferably provided at each of the ends for temperature stability. The first end channel provided at only one of the ends still can stabilize temperature on the one end.

In the case where the head body 2*a* and the printer 1 are fixed at the ends in the second direction of the head body 2*a*, more heat is conducted from the both ends of the head body 2*a* to the printer 1. Such a head body 2*a* needs to be provided with the first end channel 30 more.

The first end channel 30 has a wide portion 30*a* larger in channel width than the common channel, and the wide portion 30*a* is provided, close to the pressurization chamber surface 4-1, with a third damper 28C. The third damper 28C has a first surface facing the wide portion 30*a* and a second surface facing the damper chamber 29 so as to be deformable. A damper has damping performance largely influenced by a portion having the narrowest width in a deformable region. Because increase in width of the common channels leads to increase in size of the head body 2*a*, the common channels cannot have a very large width. The first dampers 28A and the second dampers 28B provided at the common channels may not exert a sufficient damping performance. The damping performance of the third damper 28C can be improved by increasing the width of the wide portion 30*a*. The width of the wide portion 30*a* is preferably not less than twice, particularly not less than three times, of the width of the common channel.

The wide portion 30*a* is optionally provided, close to the discharge hole surface 4-2, with a damper for higher damping performance. The first end channel 30 is preferred to have low channel resistance for temperature stability. Extremely low channel resistance may, however, lead to an insufficient amount of liquid supplied to the common channels. The channel resistance of the first end channel 30 is preferably not less than 0.05 times, particularly 0.1 times of the channel resistance of the common channel. In order to increase channel resistance along with provision of the wide portion 30*a*, it is preferred to provide a narrowed portion 30*b* smaller in width than the wide portion 30*a*. Provision of two wide portions 30*a* and the narrowed portion 30*b* disposed therebetween stabilizes by means of damping on both of the liquid supply side and the liquid drain side, and causes liquid vibration to be unlikely to be transmitted between the supply side and the drain side, so that variation on the supply side is unlikely to influence the drain side whereas variation on the drain side is unlikely to influence the supply side.

The first end channel 30 preferably has channel resistance allowing at least 80% of the amount of liquid flowing in the entire channels to flow into the common channels in consideration of the configuration of the common channels. Specifically, the following configuration is preferred, inclusive of the second end channel to be described later. Assume that n0 common channels having channel resistance R0, n1 first end channels 30 having channel resistance R1, and n2 second end channels having channel resistance R2 are connected parallelly to have entire channel resistance R. Furthermore, assume that liquid flowing in one common channel has a flow rate U0, liquid flowing in one first end channel 30 has a flow rate U1, and liquid flowing in one second end channel has a flow rate U2, to have a total flow rate U. The above relations establish $1/R=n0/R0+n1/R1+n2/R2$, $U=n0\times U0+n1\times U1+n2\times U2$, and $U0\times R0=U1\times R1=U2\times R2$. The above condition is expressed as $U0\geq 0.8\times U$. When the above relations are applied, it is found to preferably satisfy $(n0\times R1\times R2)/(n0\times R1\times R2+n1\times R2\times R0+n2\times R0\times R1)\geq 0.8$. In a case where there are a large number, such as ten or more, of common channels, the channel resistance of the first end channel 30 is preferably 0.5 to 0.9 times of the channel resistance of the common channel. The present embodiment provides a first dummy pressurization chamber row 11D1 including the first dummy pressurization chamber 10D1 and the pressurization chambers 10 aligned therein and a second dummy pressurization chamber row 11D2 including the second dummy pressurization chambers 10D2, which are provided outside, in the second direction, the pressurization chamber row 11A including the pressurization chamber 10 capable of discharging liquid. The pressurization chamber row 11A including only the pressurization chambers 10 is provided, outside in the second direction, with one first dummy pressurization chamber row 11D1. The first dummy pressurization chamber row 11D1 is provided, outside in the second direction, with one second dummy pressurization chamber row 11D2.

The first dummy pressurization chamber 10D1 is not connected with any discharge hole 8. The first dummy pressurization chamber 10D1 does not have any corresponding individual electrode 44. Other than the above features, the first dummy pressurization chamber 10D1 is configured substantially similarly to the pressurization chamber 10. The first dummy pressurization chamber row 11D1 includes eight first dummy pressurization chamber rows 10D1 aligned close to the opening 20*a* of the first common channel 20, and eight pressurization chambers 10 aligned close to the opening 24*a* of the second common channel 24.

The second dummy pressurization chamber 10D2 is not connected with any discharge hole 8. The second dummy pressurization chamber 10D2 does not have any corresponding individual electrode 44. Furthermore, the second dummy pressurization chamber row 11D2 is partially disposed outside the piezoelectric actuator substrate 40. Accordingly, the second dummy pressurization chambers 10D2 each have a second dummy pressurization chamber body 10D2*a* disposed at the plate 4*b* positioned closer to the discharge hole surface 4-2 than and next to the plate 4*a* provided with the pressurization chamber bodies 10*a* and closed by the plate 4*a*. Other than the above features, the second dummy pressurization chamber 10D2 is configured substantially similarly to the pressurization chamber 10.

A common channel according to the present invention is configured to (directly) supply and drain liquid to and from the pressurization chamber 10 capable of discharging liquid. According to the present embodiment, one dummy second common channel 24D is disposed each outside, in the second direction, the common channel group including the common channels. The dummy second common channel 24D will be called a second end channel. The first end channel 30 is disposed further outside the second end channel.

The first common channel 20 positioned at a distal end of the common channel group receives liquid drained only from one pressurization chamber row 11A (the first dummy pressurization chamber row 11D1). The other first common channels 20 each receive liquid drained from two pressurization chamber rows 11A. The pressurization chambers 10, which receive liquid supplied from the first common channel 20 at the distal end, may have a liquid flow condition largely different from that of the other pressurization chambers 10 to have a different discharge property. The first dummy pressurization chamber row 11D1 includes eight pressurization chambers 10 configured to discharge liquid, which are less than the pressurization chambers 10 in the other pressurization chamber rows 11A, and will have liquid supply and drain states largely different from the pressurization chamber rows 11A.

In view of this, the first dummy pressurization chamber row 11D1 includes eight first dummy pressurization chambers 10D1 in order to eliminate the difference of the liquid supply and drain states. The total number of the first dummy pressurization chambers 10D1 and the pressurization chamber 10 included in the first dummy pressurization chamber row 11D1 is thus equal to the number of the pressurization chambers 10 in the other pressurization chamber rows 11A. Furthermore, the dummy second common channel 24D is disposed outside the first common channel 20 at each of the distal ends, and the second dummy pressurization chambers 10D2 are disposed therebetween. A dummy individual channel including the first dummy pressurization chamber 10D1 and a dummy individual channel including the second dummy pressurization chamber 10D2 are substantially equal in channel property to the individual channel. The first common channel 20 at the distal end receives liquid drained from one first dummy pressurization chamber row 11D1 and one second dummy pressurization chamber row 11D2, and thus allows the pressurization chambers 10 included in the first dummy pressurization chamber row 11D1 at the distal end to be equal in discharge property to the other pressurization chambers 10.

The first end channel 30 is unlikely to allow transmission of temperature variation generated at the end in the second direction of the head body 2*a* to the common channels. In a case where liquid supplied to the head body 2*a* has temperature variation, the temperature variation is faster around the first end channel 30 than the other portions, and the pressurization chambers 10 at the end in the second direction are likely to be influenced by the temperature variation. When the dummy second common channel (the second end channel) 24D is provided outside, in the second direction, the first common channel 20, temperature variation of the first end channel 30 is unlikely to be transmitted to the common channels.

The dummy second common channel (the second end channel) 24D is connected with the common channels via the second dummy pressurization chambers 10D2, and is thus preferred to be substantially equal in channel resistance to the second common channels 24 to keep the liquid flow rate balanced. Substantially equal channel resistance herein includes channel resistance within ±30%, further within ±20%, and particularly within ±10%.

There can be provided a dummy pressurization chamber configured similarly to the first dummy pressurization chamber 10D1 at the position of the second dummy pressurization chamber 10D2, in which case the piezoelectric actuator substrate 40 needs to be sized to cover also the second dummy pressurization chamber row 11D2. The channel resistance of the dummy individual channel including the second dummy pressurization chamber 10D2 is less necessary to be approximate to the channel resistance of an individual channel including the pressurization chamber 10 than the channel resistance of the dummy individual channel including the first dummy pressurization chamber 10D1. In view of this, the second dummy pressurization chamber body 10D2*a* is disposed at the plate 4*b* immediate below the plate 4*a* and is closed not by the piezoelectric actuator substrate 40 but by the plate 4*a*. This configuration achieves reduction in size of the piezoelectric actuator substrate 40.

The first common channels 20 are not directly connected with the second integrated channel 26 and the second common channels 24 are not directly connected with the first integrated channel 22 in the above embodiment. The present invention is not limited to such a mode. Specifically, the common channels can alternatively directly connect the first integrated channel 22 and the second integrated channel 26.

Figure 7:
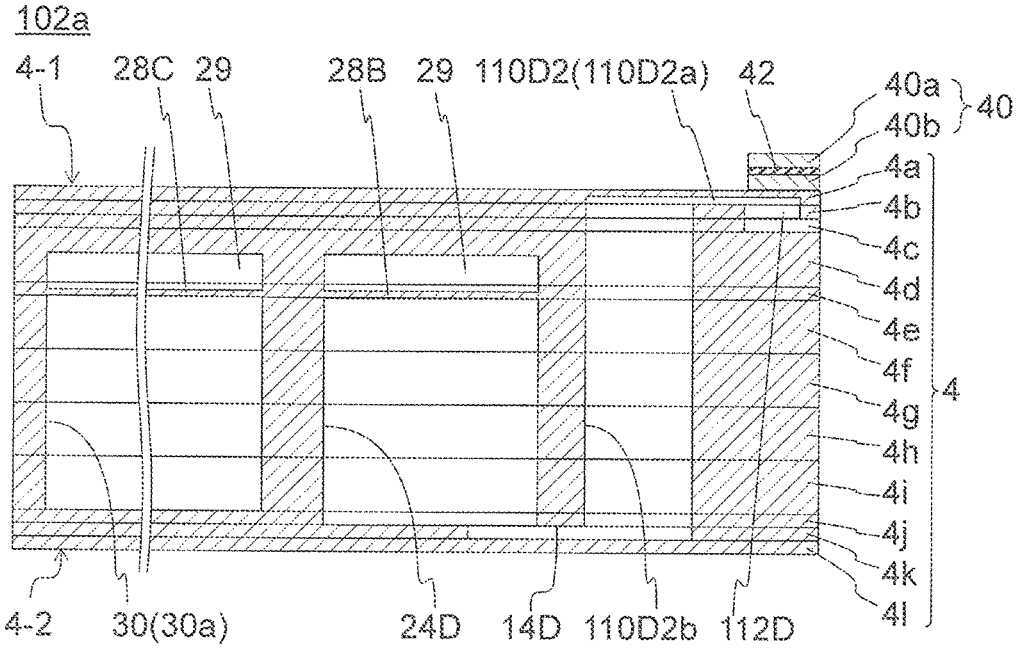
FIG. 7 is a partial longitudinal sectional view of a head body according to another embodiment of the present invention.

FIG. 7 is a partial longitudinal sectional view of a liquid discharge head body 102*a* according to another embodiment of the present invention and depicts a portion corresponding to FIG. 5(*b*). The head body 102*a* is basically configured similarly to the head body 2*a* depicted in FIGS. 2(*a*) to 6, and portions having small differences will be denoted by identical reference numerals and will not be described repeatedly.

The head body 102*a* includes a second dummy pressurization chamber body 110D2*a* that is configured by a groove provided in the plate (pressurization chamber plate) 4*a* and opened to the lower surface, i.e. not facing the stacked piezoelectric actuator substrate 40, and the plate 4*c* mostly closing the groove. The portion not closed by the plate 4*c* is connected with a second dummy descender 110D2*b* and a dummy first individual channel 112D. The second dummy pressurization chamber body 110D2*a* is configured by the groove opened to the lower surface of the plate (pressurization chamber plate) 4*a* and is not opened to the upper surface of the plate (pressurization chamber plate) 4*a*. It is thus unnecessary to dispose the piezoelectric actuator substrate 40 on the second dummy pressurization chamber body 110D2*a*. Such a groove can be formed by half etching the plate 4*a* made of a metal or the like.

Similar to the second dummy pressurization chamber body 10D2*a* of the head body 2*a*, the second dummy pressurization chamber body 110D2*a* of the head body 102*a* achieves reduction in rigidity difference of the peripheries of the pressurization chambers 10 and reduction in flow rate difference of the common channels.

The embodiments described above exemplify the pressurization chamber plate and the dummy pressurization chamber plate, each of which is configured by a single plate. These plates can alternatively be configured by a plurality of stacked plates.

DESCRIPTION OF THE REFERENCE NUMERALS

1: Color ink jet printer
2: Liquid discharge head
2*a*, 102*a*: Head body
4: First channel member
4*a*-4*l*: Plate (of first channel member)
4-1: Pressurization chamber surface
4-2: Discharge hole surface
6: Second channel member
6*a*, 6*b*: Plate (of second channel member)
6*ba*, 6*bb*: Partition
6*c*: Through hole (of second channel member)
6*ca*: Widened portion of through hole
8: Discharge hole
9A: Discharge hole row
9B: Discharge hole line
10: Pressurization chamber
10*a*: Pressurization chamber body
10*b*: Partial channel (Descender)
10D1: First dummy pressurization chamber
10D2, 110D2: Second dummy pressurization chamber
10D2*a*, 110D2*a*: Second dummy pressurization chamber body
10D2*b*, 110D2*b*: Second dummy partial channel (Dummy descender)
11A: Pressurization chamber row
11B: Pressurization chamber line
11C: Pressurization chamber group
12: First individual channel
12D, 112D: Dummy first individual channel
14: Second individual channel
14D: Dummy second individual channel
20: First common channel
20*a*: Opening (of first common channel)
22: First integrated channel
22*a*: First integrated channel body
22*b*: First connection channel
22*c*, 22*d*: Opening (of first integrated channel)
24: Second common channel
24*a*: Opening (of second common channel)
24D: Dummy second common channel (Second end channel)
26: Second integrated channel
26*a*: Second integrated channel body
26*b*: Second connection channel
26*c*, 26*d*: Opening (of second integrated channel)
28A: First damper
28B: Second damper

28C: Third damper
29: Damper chamber
30: First end channel
30*a*: Wide portion
30*b*: Narrowed portion
30*c*, 30*d*: Opening (of first end channel)
40: Piezoelectric actuator substrate
40*a*: Piezoelectric ceramic layer
40*b*: Piezoelectric ceramic layer (Vibration plate)
42: Common electrode
44: Individual electrode
44*a*: Individual electrode body
44*b*: Extraction electrode
46: Connection electrode
50: Displacement element (Pressurizing part)
70: Head mount frame
72: Head group
80A: Paper feed roller
80B: Collect roller
82A: Guide roller
82B: Convey roller
88: Controller
P: Printing paper

The invention claimed is:

1. A liquid discharge head comprising: a channel member including a plurality of discharge holes, a plurality of pressurization chambers connected with the plurality of discharge holes, respectively, and a dummy pressurization chamber; and a substrate disposed on the channel member and including a plurality of pressurizing parts configured to pressurize the plurality of pressurization chambers, respectively;

wherein the channel member includes a plurality of stacked plates, and the plurality of plates includes a pressurization chamber plate and a dummy pressurization chamber plate, wherein the dummy pressurization chamber plate has a hole or a groove, the hole or the groove has a side surface configuring a side surface of the dummy pressurization chamber, and the hole or the groove has an opening configuring an opening of the dummy pressurization chamber, wherein the pressurization chamber plate has a plurality of holes or a plurality of grooves, each hole or each groove has a side surface configuring a side surface of the pressurization chamber, and each hole or each groove has an opening configuring an opening of the pressurization chamber in the plurality of pressurization chambers, wherein a plurality of the openings of the pressurization chambers is closed by the substrate, and the opening of the dummy pressurization chamber is closed by the pressurization chamber plate.

2. A recording device comprising: the liquid discharge head according to claim 1; a conveyor configured to convey a recording medium relatively to the liquid discharge head; and a controller configured to control the liquid discharge head.

3. The liquid discharge head according to claim 1, wherein the dummy pressurization chamber is disposed outside a pressurization chamber group comprising the plurality of pressurization chambers.

4. The liquid discharge head according to claim 1, wherein the substrate can be reduced in size to not overlap with the dummy pressurization chamber in plan view.

5. The liquid discharge head according to claim 1, wherein the channel member includes a common supply channel for supply of liquid to at least one of the plurality of pressurization chambers or the dummy pressurization chamber, and a common collect channel for collection of liquid from at least one of the plurality of pressurization chambers or the dummy pressurization chamber.

6. The liquid discharge head according to claim 5, wherein the dummy pressurization chamber plate is provided directly to the pressurization chamber plate on a surface not facing the substrate.

7. The liquid discharge head according to claim 6, wherein the dummy pressurization chamber plate is provided with a plurality of holes, each hole serving as a channel for supply of liquid to the pressurization chamber in the plurality of pressurization chambers and a channel for collection of liquid from the pressurization chamber in the plurality of pressurization chambers, and each of the channels allows liquid to shift vertically.

8. The liquid discharge head according to claim 5, wherein the pressurization chamber and the dummy pressurization chamber are substantially equal in height.

* * * * *